US005435727A

United States Patent [19]

Dobson

[11] Patent Number: 5,435,727

[45] Date of Patent: Jul. 25, 1995

[54] GOLF TEACHING AID

[76] Inventor: Larry W. Dobson, #5-9113 19 St. SW., Calgary, Alberta, Canada, T2V 1R3

[21] Appl. No.: 131,979

[22] Filed: Oct. 4, 1993

[51] Int. Cl.[6] ..... A63B 69/36

[52] U.S. Cl. ..... 434/252; 273/187 R

[58] Field of Search ..... 434/252; 273/187 R, 273/187 A, 187 B, 187.1

[56] References Cited

U.S. PATENT DOCUMENTS

| | | | |
|---|---|---|---|
| 3,229,981 | 1/1966 | Taber | 434/252 |
| 3,244,421 | 4/1966 | Hanna | 434/252 |
| 3,658,344 | 4/1972 | Kimble | 273/187 R |
| 3,658,394 | 4/1972 | Peters | 273/187 R |
| 3,868,116 | 2/1975 | Ford et al. | 273/187 R |
| 4,784,393 | 11/1988 | Williams et al. | 273/187 R |
| 5,013,044 | 5/1991 | Hesselhart | 273/187 R |
| 5,246,234 | 9/1993 | Zambelli | 434/252 |
| 5,255,921 | 10/1993 | Spence | 434/252 |
| 5,320,355 | 6/1994 | Johnson | 273/187 R |

*Primary Examiner*—Paul J. Hirsch
*Attorney, Agent, or Firm*—Jerry T. Kearns

[57] ABSTRACT

A golf teaching aid includes a primary hinge member having a first arm pivotally connected to a second arm. The first arm is movable relative to the second arm between a stored position wherein the first arm and the second arm are parallel and an operative position wherein the first arm and the second arm are set in angular relation. A first tubular member extends from the first arm. The first tubular member has a first telescopic member which is telescopically received within the first tubular member. A second tubular member has a second telescopic member which is telescopically received within the second tubular member. A target pointer member is pivotally secured to the first telescopic member. The positioning of the target pointer member relative to the second telescopic member is adjustable by extension of the first telescopic member whereby the target pointer member points to the preferred position for ball placement relative to the second tubular member and points toward a target. A foot positioning member is pivotally secured to the second telescopic member. The foot positioning member provides a reference guide to foot positioning. A ball positioning member is slidably movable along and pivotally secured to the second telescopic member. The ball positioning member is slidably adjustable to point to the preferred position for ball placement relative to the foot positioning member.

20 Claims, 3 Drawing Sheets

GOLF TEACHING AID

BACKGROUND OF THE INVENTION

The present invention relates to a golf teaching aid.

The key to excelling in the game of golf lies in establishing consistent alignment and a consistent swing. Golf teaching aids are generally intended to break down a golfer's address and swing into its fundamental aspects, namely: body alignment to target, ball position in stance, ball distance from body, hand position in the address, club face square to target, consistent club take away and consistent swing.

U.S. Pat. No. 3,041,075, granted to Taylor in 1962, discloses a golf teaching aid which has an elongated base member with detachably connected foot guides. The foot guides are received in holes in the base member. A tee guide is attached to the elongated base member by means of a cord. A ball flight indicator is provided on the elongate base member in the form of a small dial.

United Kingdom Patent application 2,087,241 by Wolland, published in 1982, discloses two elongate members slidable relative to one another. One of the elongate members provides a visual reference with respect to ball positioning; the other of the elongate members provides a visual reference with respect to foot positioning.

U.S. Pat. No. 4,647,048, granted to Welch in 1987, discloses an elongate base having two pivotally connected telescopic arms. The tip of the elongate base serves as an indicator for ball positioning. Foot guides are attached to each of the arms.

U.S. Pat. No. 4,925,192, granted to Forbes in 1990, discloses a plurality of tubular members which are adapted to nest together for the purpose of storage. The tubular members fasten together by mating a plurality of pins in selected holes. When assembled there is a base member against which a user stands, a guide for the left foot, a guide for the right foot and a locator bar for locating a golf ball.

These golf teaching aids have failed to come into widespread use for a number of reasons. Some of the golf teaching aids restrict movement of the golfer's feet. Some of the golf teaching aids are comparably time consuming to assemble and disassemble. In the design of some of the golf teaching aids utility has been sacrificed in order to maintain a compact design.

SUMMARY OF THE INVENTION

What is required is an alternate form of golf teaching aid which better meets the needs of the golfer.

According to the present invention there is provided a golf teaching aid which includes a primary hinge member having a first arm pivotally connected to a second arm. The first arm is movable relative to the second arm between a stored position wherein the first arm and the second arm are parallel and an operative position wherein the first arm and the second arm are set in angular relation. A first tubular member extends from the first arm. The first tubular member has a first telescopic member which is telescopically received within the first tubular member. Means is provided to maintain the first tubular member and the first telescopic member in a predetermined relative telescopic position. A second tubular member extends from the second arm. The second tubular member has a second telescopic member which is telescopically received within the second tubular member. Means is provided to maintain the second tubular member and the second telescopic member in a predetermined relative telescopic position. A target pointer member is pivotally secured to the first telescopic member. The target pointer member is pivotally movable relative to the first telescopic member between a stored position wherein the target pointer member and the first telescopic member are parallel and an operative position wherein the target pointer member and the first telescopic member are set in angular relation. The positioning of target pointer member relative to the second telescopic member being adjustable by extension of the first telescopic member whereby the target pointer member points to the preferred position for ball placement relative to the second tubular member and points toward a target. A foot positioning member is pivotally secured to the second telescopic member. The foot positioning member is pivotally movable relative to the second telescopic member between a stored position wherein the foot positioning member and the second telescopic member are parallel and an operative position wherein the foot positioning member and the second telescopic member are set in an angular relation. The foot positioning member provides a reference guide to foot positioning. A ball positioning member is slidably movable along and pivotally secured to the second telescopic member. The ball positioning member is pivotally movable relative to the second telescopic member between a stored position wherein the ball positioning member and the second telescopic member are parallel and an operative position wherein the ball positioning member and the second telescopic member are set in an angular relation. The ball positioning member is slidably movable along the second telescopic member, whereby the ball positioning member is slidably adjustable to point to the preferred position for ball placement relative to the foot positioning member.

The golf teaching aid, as described, can be folded or unfolded about its various pivot points in a matter of seconds. In the stored "mode", it is very compact enabling it to be fit within a golf bag. In the "operative" mode, the golf teaching aid provides the assistance a golfer needs in the fundamental elements which effect the building of consistent alignment and a consistent swing. The inter-relationship between the target pointer member and the second tubular member ensures that the golf teaching aid is correctly aligned with a target and enables the user to correctly align his or her body to the target. The inter-relationship of the foot positioning member and the ball positioning member enables the golfer to ensure the correct ball placement relative to the front foot when in a hitting stance. The inter-relationship of the ball positioning member and the target pointing member enables the golfer to ensure that the ball is placed an appropriate distance from his or her body.

Although beneficial results may be obtained through the use of the golf teaching aid as described, even more beneficial results will be obtained if the first telescopic member and the second telescopic member are marked in graduated increments to assist in rapid, accurate, and consistent placement of the target pointer member, and the ball positioning member.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
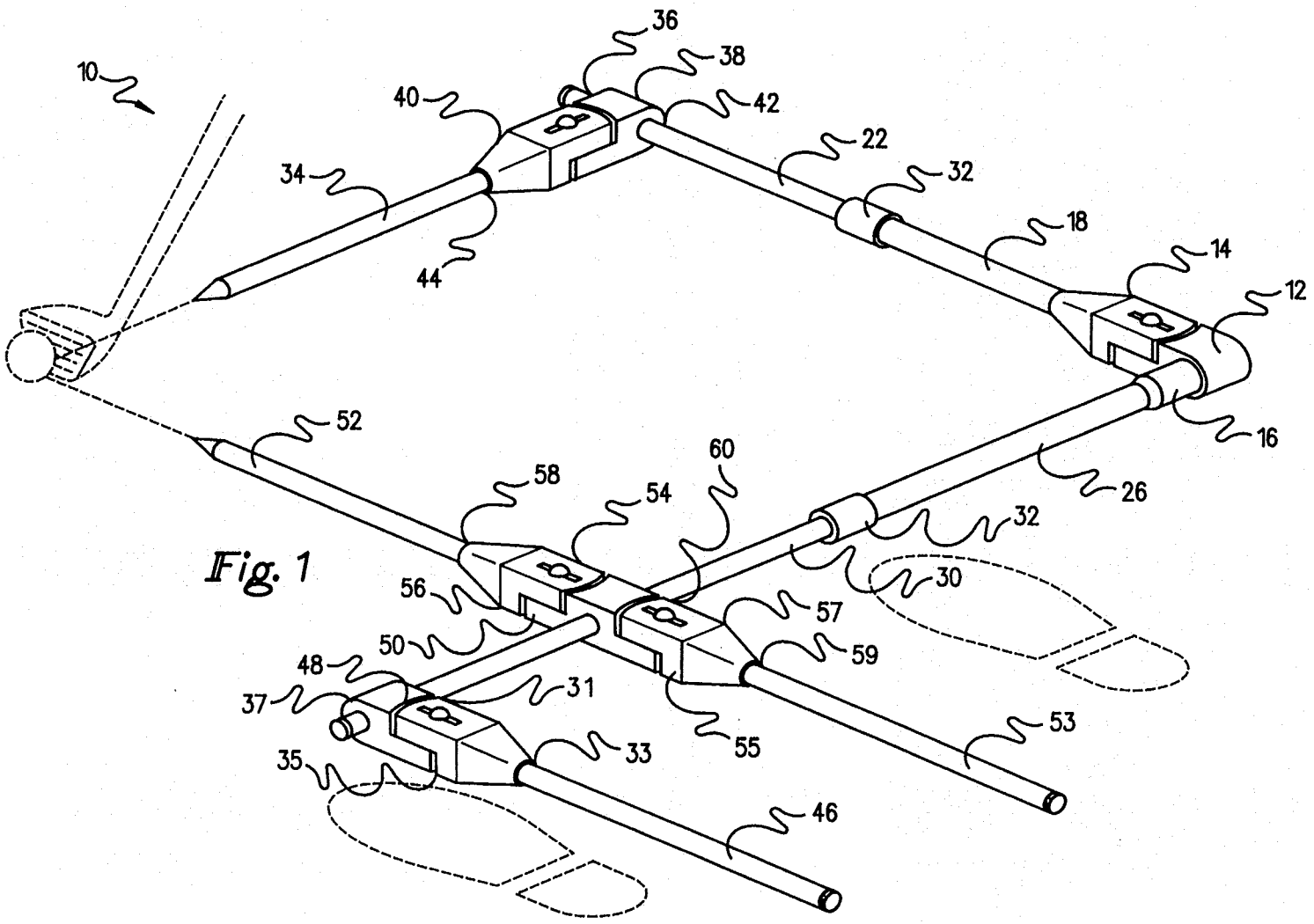
FIG. 1 is a perspective view of a golf teaching aid constructed in accordance with the teachings of the present invention, in an operative position set in an angular position for a straight shot.

The preferred embodiment, a golf teaching aid generally identified by reference numeral 10, will now be described with reference to FIGS. 1 through 4.

Figure 2:
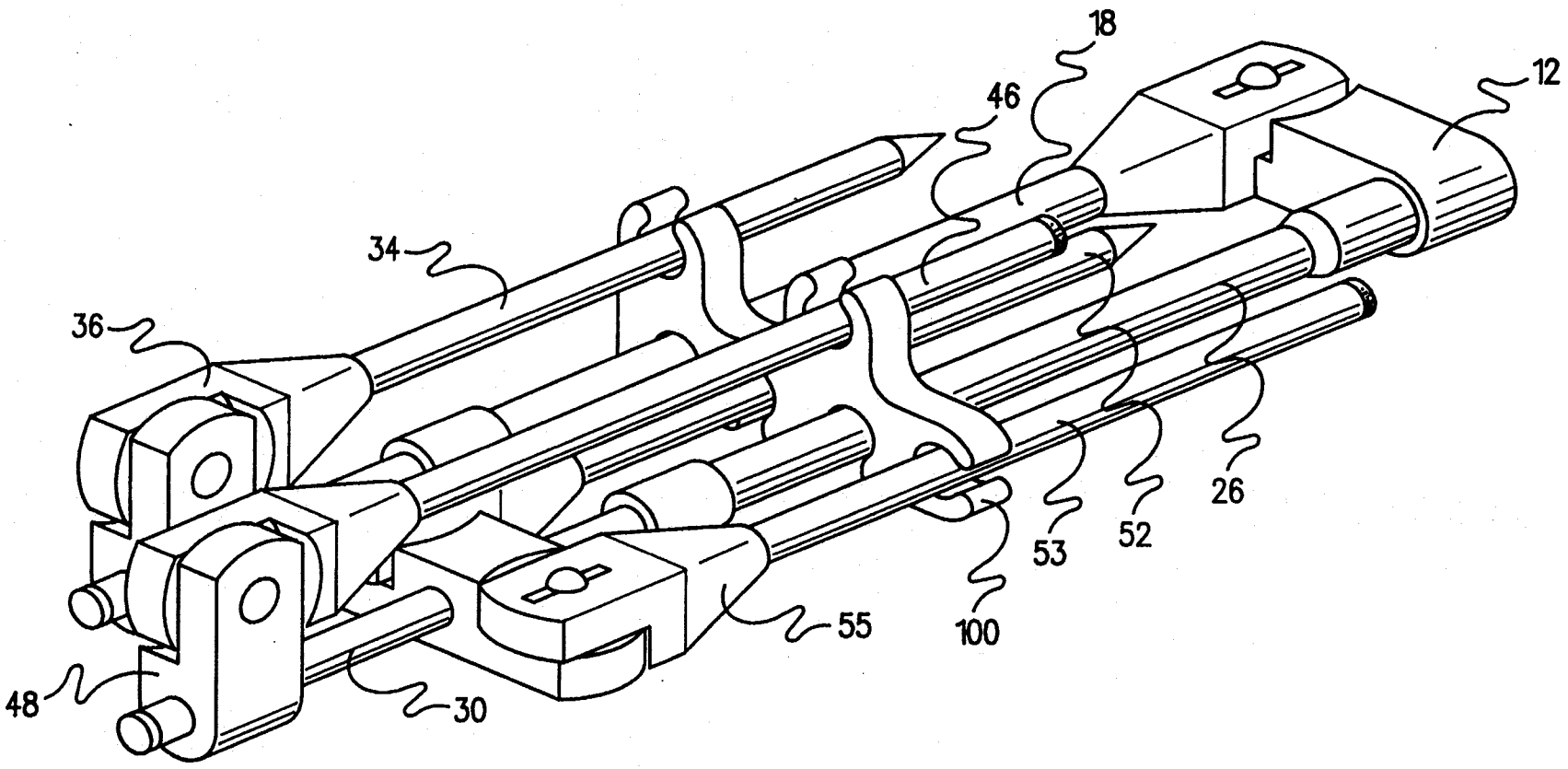
FIG. 2 is a perspective view of the golf teaching aid illustrated in FIG. 1 in a stored position.

Referring to FIG. 1, golf teaching aid 10 consists of a primary hinge member 12 which has a first arm 14 pivotally connected to a second arm 16. First arm 14 is movable relative to second arm 16 between a stored position and an operative position. There are a range of operative positions between 76 degrees and 104 degrees for use in practicing a straight shot, a hook, or a slice. Typically the golf teaching aid will be used in practicing for a straight shot as illustrated in FIG. 1, as will be further described in relation to the use and operation of the invention. Referring to FIG. 2, in the stored position first arm 14 and second arm 16 are parallel.

Figure 4:
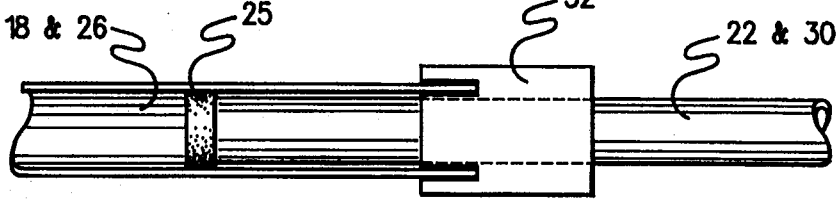
FIG. 4 is a detailed side elevation view in longitudinal section of a portion of the golf teaching aid illustrated in FIG. 1.

Referring to FIG. 1, a first tubular member 18 extends from first arm 14. First tubular member 18 has a first telescopic member 22 which is telescopically received within first tubular member 18. Second tubular member 26 has a second telescopic member 30 which is telescopically received within a second tubular member 26. Referring to FIG. 4, a friction fit bushing 25 is positioned on an end of first telescopic member 22 received by first tubular member 18 and on an end of second telescopic member 30 received by second tubular member 26. Friction fit bushing 25 serves as means to maintain first tubular member 18 and first telescopic member 22 in a predetermined relative telescopic position, and similarly, second tubular member 26 and second telescopic member 30 in a predetermined relative telescopic position. Both first tubular member 18 and second tubular member 26 have annular end caps 32 through which extend first telescopic member 22 and second telescopic member 30, respectively. End cap 32 engages bushing 25 thereby serving as a stop means to prevent telescopic members 22 and 30 from being withdrawn from tubular members 18 and 26, respectively. As previously described bushing 25 is friction fit so a force must be exerted to alter the relative telescopic position of the tubular member and the telescopic member. The presence of annular end cap 32 prevents the telescopic member from being withdrawn from the tubular member as bushing 25 will not pass through annular end cap 32. A target pointer member 34 is pivotally secured to the first telescopic member 32. Target pointer member 34 is pivotally attached to first telescopic member 22 by a hinge 36. There are a variety of hinges commercially available which are suitable for use, an "interlocking" style of hinge is preferred, as illustrated. The advantageous feature of an interlocking hinge is that it has a friction lock which maintains it in its preset operative or stored position. Hinge 36 consists of two pivotally connected members 38 and 40. Members 38 and 40 have bores 42 and 44, respectively. First telescopic member 22 is held in a friction fit within bore 42 of member 38. Target pointer member 34 is held in a friction fit within bore 44 of member 40. Hinge 36 enables target pointer member 34 to be pivotally movable relative to first tubular member 18 and first telescopic member 22 between a stored position and an operative position. Referring to FIG. 2 there is illustrated the stored position wherein target pointer member 34 and first tubular member 18 are parallel. Referring to FIG. 1, there is illustrated one of the operative positions wherein target pointer member 34 and first telescopic member 18 are adjacent and form a substantially 90 degree angle. A foot positioning member 46 is pivotally secured to second telescopic member 30 by a hinge 48. Hinge 48 is of like construction to hinge 36. Hinge 48 consists of two pivotally connected members 35 and 37. Members 35 and 37 have bores 33 and 31, respectively. Second telescopic member 30 is held in a friction fit within bore 33 of member 35. Foot positioning member 46 is held in a friction fit within bore 31 of member 37. Hinge 48 enables foot positioning member 46 to be pivotally movable relative to second tubular member 26 and second telescopic member 30 between a stored position and an operative position. Referring to FIG. 2 in the stored position foot positioning member 46 and second tubular member 26 are parallel. Referring to FIG. 1, illustrating one of the operative positions, foot positioning member 46 and second telescopic member 30 are adjacent and form a substantially 90 degree angle. A ball positioning member 52 and secondary foot positioning member 53 are pivotally secured to a slidable base 50 which is slidably movable along second telescopic member 30. Mounted to base 50 are two hinges 54 and 55 which are similar in construction to hinges 36 and 48. Hinges 54 and 55 have members 56 and 57 which are pivotally mounted to base 50. Members 56 and 57 have bores 58 and 59, respectively. Ball positioning member 52 is held in a friction fit within bore 58 of member 56. Secondary foot positioning member 53 is held in friction fit within bore 59 of member 57. Base member 50 has a bore 60. Second telescopic member 30 is held in friction fit within bore 60. Hinge 54 enables ball positioning member 52 to be pivotally movable relative to second tubular member 26 and second telescopic member 30 between a stored position and an operative position. Referring to FIG. 2 there is illustrated the stored position in which ball positioning member 52 and second tubular member 26 are parallel. Referring to FIG. 1, there is illustrated one of the operative positions in which ball positioning member 52 and second telescopic member 30 are adjacent and form a substantially 90 degree angle. Hinge 55 enables secondary foot positioning member 53 to be pivotally movable relative to second tubular member 26 and second telescopic member 30 between a stored position and an operative position. Referring to FIG. 2, there is illustrated the stored position in which secondary foot positioning member 53 and second tubular member 26 are parallel. Referring to FIG. 1, there is illustrated one of the operative positions in which secondary foot positioning member 53 and second telescopic member 30 are adjacent and form a substantially 90 degree angle.

With target pointer member 34 and foot positioning member 46 relative adjustment can be accomplished by telescopic extension of first telescopic member 22 and second telescopic member 30, respectively. However, both foot positioning member 46, ball positioning member 52 and secondary foot positioning member 53 are secured to second telescopic member 30. Spacial adjustment of ball positioning member 52 and secondary foot positioning member 53 relative to foot positioning member 46 is therefore accomplished by sliding base 50 along second telescopic member 30. In view of the fact that second telescopic member 30 is held in a friction fit within bore 60; this adjustment is made by sliding base 50 to which ball positioning member 52 and secondary foot positioning member 53 are attached along second telescopic member 30. To assist in the positioning of target pointer member 34, foot positioning member 46 and ball positioning member 50, graduated markings may be provided.

The use and operation of golf teaching aid 10 will now be described with reference to FIGS. 1 through 4. From the stored position, as illustrated in FIG. 2, golf teaching aid 10 is placed in the operative position. The adjustment to the operative position is effected by pivoting primary hinge member 12 and each of cylindrical secondary hinges 36, 48, 54 and 55 to the operative position. When in the operative position golf teaching aid 10 assumes the configuration illustrated in FIG. 1. The adjustment takes a matter of a few seconds. Once in the operative position it is necessary to adjust the relative elements of golf teaching aid 10 to ensure that a golfer using golf teaching aid 10 is assuming a stance which will lead to several consistencies in address and swing. The positioning of target pointer member 34 relative to second tubular member 26 and second telescopic member 30 is adjustablé by extension of first telescopic member 22. Target pointer member 34 performs two vital functions. Firstly, target pointer member 34 points to the preferred position for ball placement relative to ball positioning member 52. When the golfer uses golf teaching aid 10 he stands with his feet immediately behind second tubular member 26. Target pointer member 34, is therefore, indicating the distance that the ball will be from the golfer's body. Secondly, target pointer member 34 points toward a selected target. This ensures, because target pointer member 34 and second tubular member 26 are parallel, that the body of the golfer is correctly aligned with respect to the target. Foot positioning member 46 provides a reference guide to assist the golfer in positioning his front foot. The position of foot positioning member 46 is adjustable by telescopic extension of second telescopic member 30. Ball positioning member 52 is slidably adjustable by sliding second telescopic member 30 through bore 60 of base 50 until the desired positioning of ball positioning member 52 is attained relative to foot positioning member 46. Ball positioning member 52 serves two vital functions. Firstly, ball positioning member 52 points to the preferred position for ball placement relative to foot positioning member 46, or in other words the relative positioning of the ball in relation to the golfer's front foot when he or she is in a hitting stance. Secondly, ball positioning member 52 serves as a reference to ensure the club face is square to the body and to the target. Secondary foot positioning member 53 provides a means of reference for the golfer as to the positioning of his back foot relative to the ball.

Figure 3:
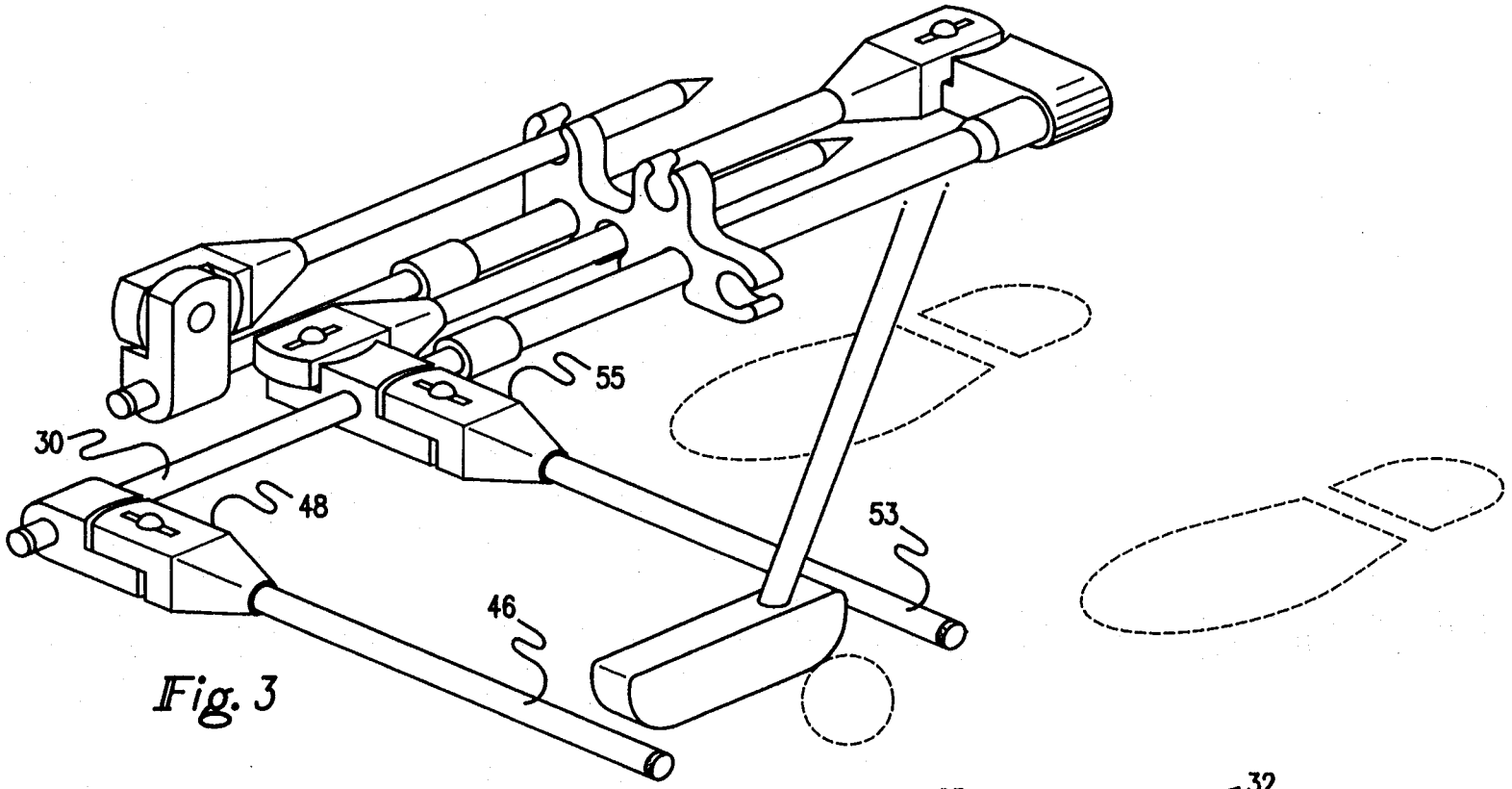
FIG. 3 is a perspective view of the golf teaching aid illustrated in FIG. 1, in an operative position set in an angular position for a "putting" stroke.

The use and operation of the golf teaching aid 10, when practicing putting, will now be described with reference to FIG. 3. From the stored position, as illustrated in FIG. 2, golf teaching aid 10 is placed in the position illustrated in FIG. 3. The adjustment to the operative position is effected by pivoting hinges 48 and 55 to the operative positions. The adjustment takes a matter of a few seconds. When the golfer uses golf teaching aid 10, he or she stands with both feet either behind secondary foot positioning member 53 or foot positioning member 46, depending upon whether the golfer putts right handed or left handed. With the golf ball placed between foot positioning member 46 and secondary ball positioning member 53, secondary foot positioning member 53 and foot positioning member 46 act as guides for the putter while second telescopic member 30 acts as a stop for the club during the back swing.

It will be apparent to one skilled in the art that golf teaching aid 10 provides a simple framework for teaching golfers by an easily understood and applied interrelationship of target pointer member 34, foot positioning member 46, ball positioning member 52 and secondary foot positioning member 53. It will also be apparent to one skilled in the art that the transformation of golf teaching aid 10 from the stored position to the operative positions is comparatively rapid and simple. It will also be apparent to one skilled in the art that golf teaching aid 10 in no way inhibits or limits the foot positioning, swing or putting stroke of the golfer. Finally, it will be apparent to one skilled in the art that modifications may be made to the illustrated embodiment without departing from the spirit and scope of the invention as defined by the claims.

What is claimed is:

1. A golf teaching aid, comprising:

a frame including a first length adjustable arm pivotally connected to a second length adjustable arm;

a target pointer member pivotally connected to said first arm;

a foot positioning member pivotally connected to said second arm;

a ball positioning member mounted for adjustment along and pivotally connected to said second arm, whereby the positions of said target pointer member, said foot positioning member, and said ball positioning member may be selectively adjusted for allowing said golf teaching aid to be selectively configured to a plurality of different configurations for practicing different golf shots.

2. The golf teaching aid of claim 1, wherein said first arm is telescopically adjustable.

3. The golf teaching aid of claim 1, wherein said second arm is telescopically adjustable.

4. The golf teaching aid of claim 1, wherein said target pointer member is mounted for pivotal movement about an axis substantially perpendicular to a longitudinal axis of said first arm.

5. The golf teaching aid of claim 1, wherein said ball positioning member is mounted for pivotal movement about an axis substantially perpendicular to a longitudinal axis of said second arm.

6. The golf teaching aid of claim 1, wherein said foot positioning member is mounted for pivotal movement about an axis substantially perpendicular to a longitudinal axis of said second arm.

7. The golf teaching aid of claim 1, wherein said ball positioning member and said foot positioning member are mounted for conjoint linear adjustment along said second arm.

8. The golf teaching aid of claim 1, further comprising a second foot positioning member connected to said second arm.

9. The golf teaching aid of claim 8, wherein said second foot positioning member is mounted for pivotal movement relative to said second arm.

10. The golf teaching aid of claim 8, wherein said second foot positioning member is mounted for pivotal and linear adjustment relative to said second arm.

11. The golf teaching aid of claim 1, wherein said foot positioning member is mounted for rotational adjustment about a longitudinal axis of said second arm.

12. The golf teaching aid of claim 1, wherein said target pointer member is mounted for rotational adjustment about a longitudinal axis of said first arm.

13. The golf teaching aid of claim 1, wherein said first arm, said second arm., said target pointer member, said foot positioning member, and said ball positioning member are all selectively configurable in parallel orientation for transportation and storage of said golf teaching aid.

14. The golf teaching aid of claim 1, wherein said first arm, said second arm, said target pointer member, said foot positioning member, and said ball positioning member each possess an elongated substantially cylindrical shape.

15. The golf teaching aid of claim 1, wherein said target pointer member possesses an elongated substantially cylindrical shape.

16. The golf teaching aid of claim 1, wherein said target pointer member possesses an elongated substantially cylindrical shape.

17. A golf teaching aid, comprising:

a. a primary hinge member having a first arm pivotally connected to a second arm, the first arm being movable relative to the second arm between a stored position wherein the first arm and the second arm are parallel and an operative position wherein the first arm and the second arm are set in angular relation;

b. a first tubular member extending from the first arm, the first tubular member having a first telescopic member which is telescopically received within the first tubular member, and means to maintain the first tubular member and the first telescopic member in a predetermined relative telescopic position;

c. a second tubular member extending from the second arm, the second tubular member having a second telescopic member which is telescopically received within the second tubular member, and means to maintain the second tubular member and the second telescopic member in a predetermined relative telescopic position;

d. a target pointer member pivotally secured to the first telescopic member, the target pointer member being pivotally movable relative to the first telescopic member between a stored position wherein the target pointer member and the first telescopic member are parallel and an operative position wherein the target pointer member and the first telescopic member are set in angular relation, the positioning of the target pointer member relative to the second telescopic member being adjustable by extension of the first telescopic member whereby the target pointer member points to the preferred position for ball placement relative to the second tubular member and points toward a target;

e. a foot positioning member pivotally secured to the second telescopic member, the foot positioning member being pivotally movable relative to the second telescopic member between a stored position wherein the foot positioning member and the second telescopic member are parallel and an operative position wherein the foot positioning member and the second telescopic member are set in an angular relation, such that the foot positioning member provides a reference guide to foot positioning; and f. a ball positioning member slidably movable along and pivotally secured to the second telescopic member, the ball positioning member being pivotally movable relative to the second telescopic member between a stored position wherein the ball positioning member and the second telescopic member are parallel and an operative position wherein the ball positioning member and the second telescopic member are set in an angular relation, the ball positioning member being slidably movable along the second telescopic member, whereby the ball positioning member is slidably adjustable to point to the preferred position for ball placement relative to the foot positioning member.

18. The golf teaching aid as defined in claim 1, wherein the means to maintain the tubular members and the telescopic members in a predetermined relative telescopic position comprise a friction fit bushing on an end of the telescopic member received by the tubular member.

19. The golf teaching aid as defined in claim 18, wherein the second tubular member possesses an annular end cap through which extends the telescopic member, the end cap engaging the bushing thereby serving as stop means to prevent the telescopic member from being withdrawn from the tubular member.

20. A golf teaching aid, comprising:

a. a first tubular member extending from the first arm, the first tubular member having a first telescopic member which is telescopically received within the first tubular member, a friction fit bushing on an end of the first telescopic member received by the first tubular member thereby serving as means to maintain the first tubular member and the first telescopic member in a predetermined relative telescopic position, the first tubular member having an annular end cap through which extends the first telescopic member, the end cap engaging the bushing thereby serving as a stop means to prevent the first telescopic member from being withdrawn from the first tubular member;

b. a second tubular member extending from the second arm, the second tubular member having a second telescopic member which is telescopically received within the second tubular member, a friction fit bushing on an end of the second telescopic member received by the second tubular member thereby serving as means to maintain the second tubular member and the second telescopic member in a predetermined relative telescopic position, the second tubular member having an annular end cap through which extends the second telescopic member, the end cap engaging the bushing thereby serving as a stop means to prevent the second telescopic member from being withdrawn from the second tubular member;

c. a target pointer member pivotally secured to the first telescopic member, the target pointer member being pivotally movable relative to the first telescopic member between a stored position wherein the target pointer member and the first telescopic member are parallel and an operative position wherein the target pointer member and the first telescopic member are set in angular relation, the positioning of target pointer member relative to the second telescopic member being adjustable by extension of the first telescopic member whereby the target pointer member points to the preferred position for ball placement relative to the second tubular member and points toward a target;

d. a foot positioning member pivotally secured to the second telescopic member, the foot positioning member being pivotally movable relative to the second telescopic member between a stored position wherein the foot positioning member and the second telescopic member are parallel and an operative position wherein the foot positioning member and the second telescopic member are set in an angular relation, such that the foot positioning member provides a reference guide to foot positioning; and e. a ball positioning member slidably movable along and pivotally secured to the second telescopic member, the ball positioning member being pivotally movable relative to the second telescopic member between a stored position wherein the ball positioning member and the second telescopic member are parallel and an operative position wherein the ball positioning member and the second telescopic member are set in an angular relation, the ball positioning member being slidably movable along the second telescopic member, whereby the ball positioning member is slidably adjustable to point to the preferred position for ball placement relative to the foot positioning member.

* * * * *